US006418862B1

(12) United States Patent
Heil

(10) Patent No.: US 6,418,862 B1
(45) Date of Patent: Jul. 16, 2002

(54) SHOCK ABSORBING PALLET

(75) Inventor: Julius F. Heil, Sharpsburg, GA (US)

(73) Assignee: Burnham Service Company, Inc., Peachtree City, GA (US)

( * ) Notice: Subject to any disclaimer, the term of this patent is extended or adjusted under 35 U.S.C. 154(b) by 0 days.

(21) Appl. No.: 09/602,411

(22) Filed: Jun. 23, 2000

(Under 37 CFR 1.47)

(51) Int. Cl.[7] ..... B65D 19/38
(52) U.S. Cl. ..... 108/57.12
(58) Field of Search ..... 108/57.12, 51.11; 248/565, 566, 600, 560, 601, 609, 638, 616, 621, 623

(56) References Cited

U.S. PATENT DOCUMENTS

| | | | | |
|---|---|---|---|---|
| 1,747,352 | A | 2/1930 | Devine, Jr. | |
| 1,812,861 | A | 7/1931 | Chase | |
| 2,973,931 | A | 3/1961 | Brown | |
| 3,090,331 | A | 5/1963 | McCann | |
| 3,101,063 | A | 8/1963 | Wharton | |
| 3,119,357 | A | 1/1964 | Kirsch et al. | |
| 3,251,322 | A | 5/1966 | Downs et al. | |
| 3,267,882 | A | 8/1966 | Rapson et al. | |
| 3,275,131 | A | 9/1966 | Erickson | |
| 3,276,530 | A | 10/1966 | Borneman | |
| 3,351,027 | A | 11/1967 | Ellard, Jr. et al. | |
| 3,426,986 | A | 2/1969 | Pool | 108/57.12 X |
| 3,440,976 | A | 4/1969 | Burne | 108/51 |
| 3,523,507 | A | 8/1970 | Dubin | 108/57.12 |
| 3,664,271 | A | 5/1972 | Wolder et al. | |
| 3,677,200 | A | 7/1972 | Coccagna et al. | |
| 3,696,761 | A | 10/1972 | Brown | |
| 3,717,922 | A | 2/1973 | Witkowski | 29/421 |
| 3,824,933 | A | 7/1974 | Lind | |
| 3,858,526 | A | 1/1975 | Lombard et al. | |
| 3,868,915 | A | 3/1975 | Hafner | |
| 3,995,749 | A | 12/1976 | Haskins | |
| 4,254,873 | A | 3/1981 | Cook, III et al. | |
| 4,267,780 | A | 5/1981 | Candella | 108/52.1 |
| 4,316,419 | A | 2/1982 | Cupido | |
| 4,362,287 | A * | 12/1982 | Grongstad | 248/565 X |
| 4,597,338 | A | 7/1986 | Kreeger | |
| RE32,344 | E | 2/1987 | Wind | |
| 4,722,505 | A * | 2/1988 | Kaiser | 248/566 X |
| 4,735,321 | A | 4/1988 | Day | |
| 4,930,632 | A | 6/1990 | Eckert et al. | |
| 5,094,175 | A | 3/1992 | Christie | |
| 5,195,439 | A | 3/1993 | Harder | |
| 5,226,372 | A | 7/1993 | Frenkel et al. | 108/51.1 |
| 5,546,872 | A | 8/1996 | Young | |
| 5,582,113 | A | 12/1996 | Langenbeck | |
| 5,588,371 | A | 12/1996 | Looker | 108/57.12 X |
| 5,651,463 | A | 7/1997 | Major et al. | |
| 5,881,507 | A * | 3/1999 | Yoo et al. | 248/565 X |
| 5,911,179 | A | 6/1999 | Spiczka | |
| 5,970,886 | A | 10/1999 | Knio | |
| 6,112,672 | A | 9/2000 | Heil | |

FOREIGN PATENT DOCUMENTS

| | | |
|---|---|---|
| CH | 671 203 A5 | 8/1989 |
| DE | G8522758 | 4/1987 |
| DE | 41 40 583 A1 | 4/1993 |
| EP | 0 678453 A1 | 10/1995 |
| FR | 2.142.588 | 2/1973 |
| GB | 1 560 395 | 2/1980 |
| WO | WO 97/46456 | 12/1977 |
| WO | WO 99/02412 | 1/1999 |

* cited by examiner

*Primary Examiner*—José V. Chen
(74) *Attorney, Agent, or Firm*—Sutherland Asbill & Brennan LLP

(57) ABSTRACT

A pallet comprising a base and a plurality of support members attached to the base. Each support member comprises an upper housing, a lower housing and shock absorbing material located within the two housings. When a force or vibration is exerted on the pallet the upper housing and lower housing move to a compressed configuration thereby reducing the amount of shock transferred to the upper face of the pallet. When the force on the pallet is removed, the upper housing and lower housing return to an expanded configuration.

18 Claims, 2 Drawing Sheets

SHOCK ABSORBING PALLET

TECHNICAL FIELD

This invention relates to pallets for storing a load, and more particularly, this invention relates to pallets which reduce shock during storage and transportation of loads.

BACKGROUND OF THE INVENTION

Conventional pallets are often inadequate for the transportation and storage of sensitive items. The palletized loads are normally handled several times, either manually or by fork lift trucks, before reaching their final destination. Though securely attached to a pallet, sensitive items can become damaged by vibrations transmitted through the pallet during handling and transport of the palletized load. This is particularly true when the pallet is being set down on a hard surface.

In addition, it is not uncommon for the pallets to be subjected to abuse during the transportation of goods. The pallets may be damaged by forklift tines, mishandled or unintentionally dropped. Thus, a need exists for a durable pallet that can withstand potential harm during the transportation of goods while protecting delicate items from shocks or vibrations during handling.

SUMMARY OF THE INVENTION

The present invention fulfills the above-described need by providing a pallet with shock absorbing support members. Generally described, the pallet comprises a base having an upper face for receiving a load and a lower face. A plurality of support members are attached to the base wherein each support member comprises an upper housing, a lower housing movably attached to the upper housing, and shock absorbing material located within the upper and lower housing. The upper and lower housing move together to a compressed configuration when a force is exerted on the pallet, thereby compressing the shock absorbing material located within the housing. When the force on the pallet is reduced or removed, the upper and lower housing move apart to an expanded configuration causing the shock absorbing material to expand.

More particularly, the pallet comprises a center bolt attached to the lower housing. The center bolt passes through an orifice in the shock absorbing material, and an orifice in the upper housing. The center bolt also passes though an aperture located in the base and engages the upper face of the base, thereby attaching the support member to the base. The pallet may further comprise at least one retaining bolt which movably attaches the lower housing to the upper housing such that the upper housing and lower housing can move between the compressed and expanded configurations.

Still more particularly, the pallet may comprise a plurality of support member enclosures, wherein each support member enclosure surrounds the lower housing and at least a portion of the upper housing of a support member. When the upper housing and lower housing move to the compressed configuration, the upper housing is lowered into the support member enclosure. The center bolt may be attached to the bottom of the support member enclosure and pass through an orifice in the shock absorbing material, an orifice in the upper housing, and an orifice in the lower housing. The center bolt also passes through an aperture located in the base and engages the upper face, thereby attaching the support member to the base.

The shock absorbing material is preferably an elastomeric material. In addition, the base, upper housing, lower housing and support member enclosure are preferably made of polymer resin, such as high density polyethylene.

Other objects, features, and advantages of the present invention will be apparent from the following detailed description of embodiments of the invention, claims, and drawings.

DETAILED DESCRIPTION OF DRAWINGS

As summarized above, this invention encompasses a shock absorbing pallet for the transport of delicate or fragile loads. The pallet comprises adjustable support members which aid in absorbing any shock or vibration exerted on the pallet.

Figure 1:
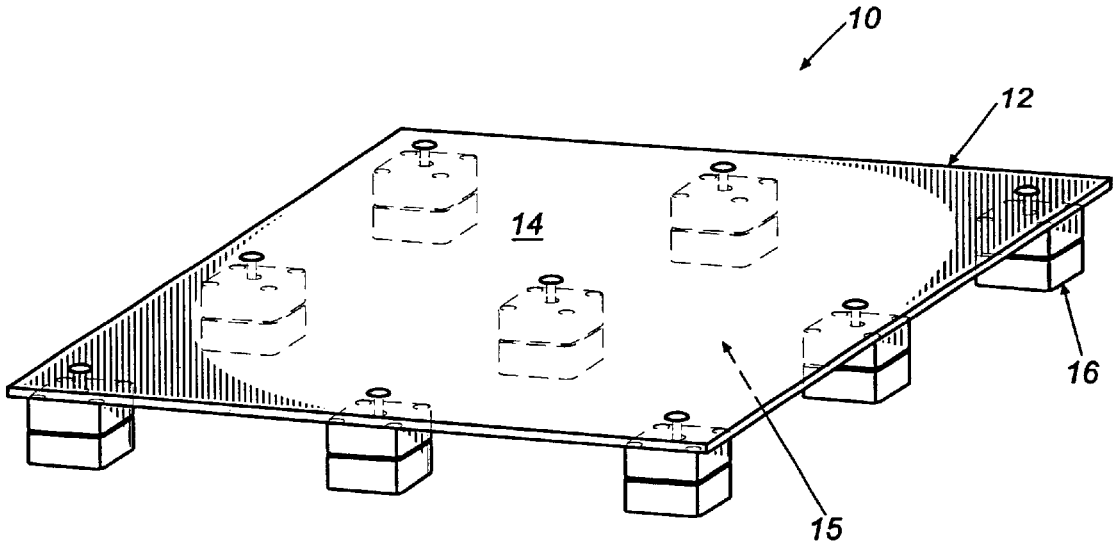
FIG. 1 is a perspective view a pallet made in accordance with an embodiment of this invention.

FIG. 1 illustrates a pallet 10 made in accordance with an embodiment of this invention. This pallet 10 includes a base 12 having an upper face 14 for receiving a load and a downwardly facing lower face 15. A plurality of support members 16 are attached to the base 12. The base 12 may be any shape, and preferably the base is substantially rectangular in shape. Typically, the support members 16 are attached to the lower face 15 of the base 12. Any number of support members 16 may be used so long as the support members provide the base 12 with adequate stability to support a load placed on the pallet 10. Preferably, the support members 16 are spaced about the base 12 such that proximate each corner of the base is positioned one of the plurality of support members.

Figure 2:
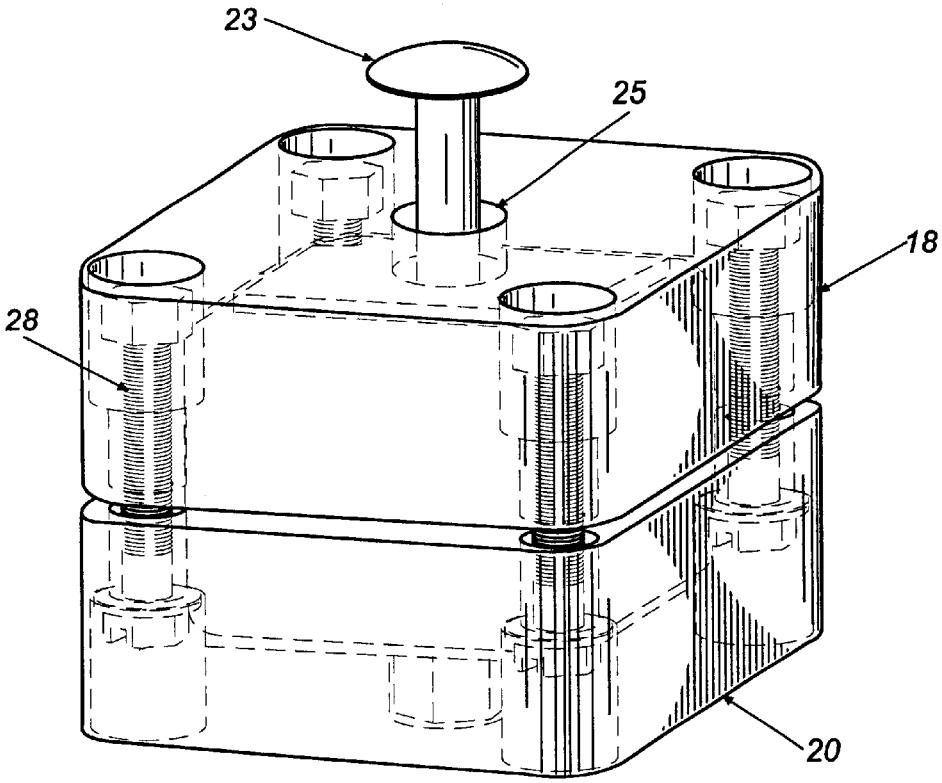
FIG. 2 is a perspective view of a support member in the pallet of FIG. 1 in a/compressed configuration.
Figure 3:
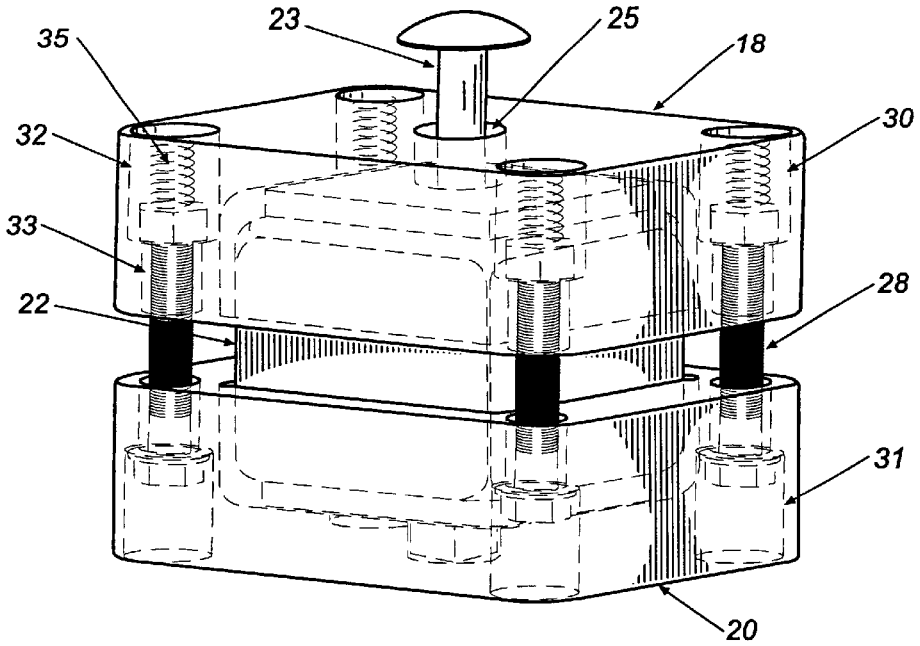
FIG. 3 is a perspective view of a support member in the pallet of FIG. 1 in an expanded configuration.

Each support member 16 comprises an upper housing 18, a lower housing 20 movably attached to the upper housing, and shock absorbing material 22 located within the upper and lower housing. When a force is exerted on the pallet 10, the upper housing 18 and lower housing 20 move together to a compressed configuration, as illustrated in FIG. 2. As the upper housing 18 and lower housing 20 move together, they compress the shock absorbing material 22. The force exerted on the pallet 10 may be the weight of a load resting on the pallet, a shock caused to the pallet when the pallet is dropped, bumped, shaken, etc., or any vibration transmitted to the pallet during transportation. When the force on the pallet 10 is reduced or removed, the upper housing 18 and lower housing 20 move apart to an expanded configuration as shown in FIG. 3. Although the upper housing 18 and lower housing 20 may be any shape, preferably they are substantially rectangular in shape with four corners.

The shock absorbing material 22 may be any resilient material capable of cushioning the palletized load including but not limited to elastomeric material or foam material. Preferably the shock absorbing material 22 is an elastomeric material. More preferably, the shock absorbing material 22 is Sorbothane (available from Sorbothane, Inc., Kent, Ohio). The compression of the shock absorbing material 22 caused by the movement of the upper housing 18 and lower housing 20, enables the shock absorbing material 22, as opposed to the palletized load, to absorb any shock or vibration to the pallet 10. As a result, sensitive items are protected during transport. The shock absorbing material 22 reduces approximately seventy percent of shock transferred to the upper face 14 of the pallet 10. In addition, the durometer and thickness measurements of the shock absorbing material 22 should be modified so that the pallet 10 can support a load of a particular weight range, while maintaining the upper housing 18 and lower housing 20 in an expanded configuration or partially expanded configuration in the absence of any additional force on the pallet.

Each support member 16 may be attached to the base 12 with a center bolt 23. The center bolt 23 passes through an aperture (not shown) located in the base 12 with the top of the center bolt engaging the upper face 14 of the base. The center bolt 23 passes through an orifice 25 in the upper housing 18 and an orifice 26 (not shown) in the shock absorbing material 22. The center bolt 23 is attached to the bottom of the lower housing 20 with a nut, thereby connecting the support member 16 to the base 12. Preferably, the center bolt 23 is arranged so that it is free floating and has minimal contact with the shock absorbing material 22. It is also desired that the bottom of the center bolt 23 does not contact the ground or surface that the pallet rests on in order to prevent the center bolt from transferring any force of shock or vibration to the upper face 14 of the pallet 10.

The pallet 10 of the present invention may further comprise at least one retaining bolt 28. The retaining bolt 28 movably attaches the lower housing 18 to the upper housing 20 so that the upper housing and lower housing can move between the compressed and expanded configurations when force is exerted on the pallet 10. The top end of the retaining bolt 28 is located within a vertical recess 30 in the upper housing 18, and the bottom end of the retaining bolt is located within a vertical recess 31 in the lower housing 20. The vertical recesses 30 and 31 are cylindrical in shape. The vertical recess 30 within the upper housing 18 is reciprocal to the vertical recess 31 within the lower housing 20, and the retaining bolt 28 has minimal contact with the interior walls of the vertical recesses. Furthermore, each vertical recess 30 and 31 comprises a wide portion 32 and a narrow portion 33 wherein the narrow portion of the recess prevents passage of the retaining bolt 28 from the recess.

In a preferred embodiment, the upper housing 18 and lower housing 20 are substantially rectangular in shape, and the pallet 10 comprises four retaining bolts 28 wherein a retaining bolt is located proximate each corner of the upper and lower housing.

A spring 35 may be located in the wide portion 32 of the vertical recess 30 in the upper housing 18. One end of the spring 35 is attached to the base of the vertical recess 30 and the other end of the spring is attached to the top of the retaining bolt 28. The spring 35 provides resistance to the compression of the upper housing 18 and lower housing 20 of the support member 16. Therefore, whenever the force of resistance exerted by the spring 35 is greater than the force of compression on the support member 16, the upper housing 18 and lower housing 20 will move apart to the expanded configuration.

Figure 4:
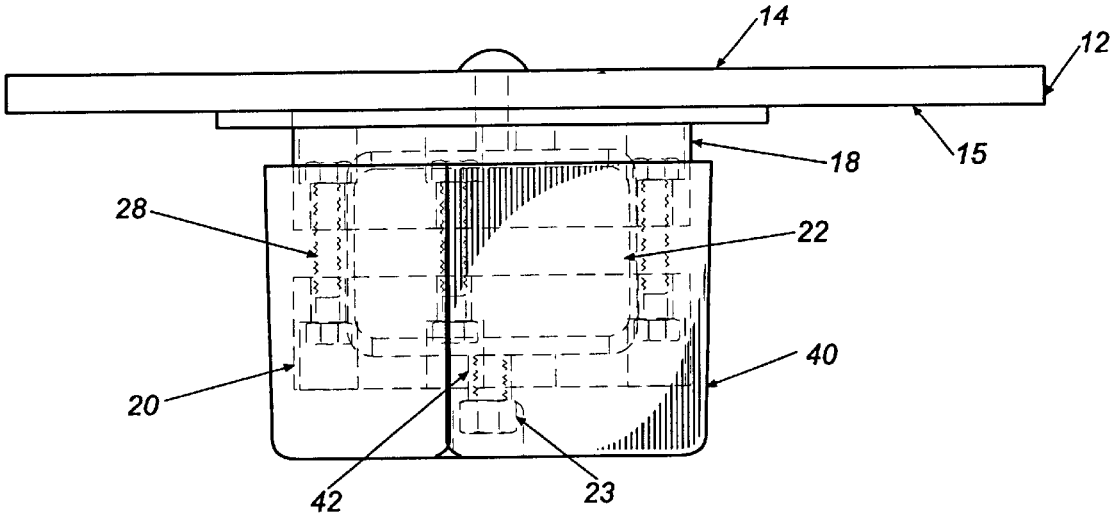
FIG. 4 is a side elevation view of a support member in the pallet of FIG. 1 including a support member enclosure.

As illustrated in FIG. 4, the pallet 10 of the present invention may further comprise a plurality of support member enclosures 40. Each support member enclosure 40 surrounds the lower housing 20 and at least a portion of the upper housing 18 of a support member 16. The support member enclosure 40 protects the support member 16 from damage during handling of the pallet 10, particularly when the pallet is handled with forklift tines. When the upper housing 18 and lower housing 20 move to the compressed configuration, the upper housing is lowered further into the support member enclosure 40.

The support member 16 may be attached to the base 12 via a center bolt 23 connected to the support member enclosure 40. The center bolt 23 passes through an aperture (not shown) located in the base 12 with the top of the center bolt engaging the upper face 14 of the base. The center bolt 23 passes through an orifice 25 in the upper housing 18, an orifice 26 in the shock absorbing material 22, and an orifice 42 in the lower housing 20. The center bolt 23 is attached to the bottom of the support member enclosure 40 with a nut, thereby connecting the support member 16 to the base 12.

The pallet 10, including the base 12, upper housing 18, lower housing 20 and support member enclosure 40 can be made of a variety of materials provided that the pallet can stand the weight of the load being stored and repeated handling such as with a forklift. Therefore, suitable materials for making the pallet 10 include wood, metal, polymer resins, such as plastic, and the like. Polymer resin is particularly desirable because many polymer resins are strong, durable, lightweight, and relatively inexpensive. In addition, many polymer resins can be injection molded. A particularly suitable resin is high density polyethylene.

The center bolt 23, retaining bolt 28 and spring 35 can each be constructed of various materials including metals such as zinc, steel, aluminum, and other alloys. Preferably, the center bolt 23, retaining bolt 28 and spring 35 are made of stainless, galvanized or zinc coated metal.

It should be understood that the foregoing relates to particular embodiments of the present invention, and that numerous changes may be made therein without departing from the scope of the invention as defined by the following claims.

I claim:

1. A shock absorbing pallet comprising:

a base having an upper face for receiving a load and a lower face; and a plurality of support members attached to the base wherein each support member comprises:

an upper housing;

a lower housing movably attached to the upper housing;

shock absorbing material located within the upper and lower housing; and a plurality of support member enclosures, each support member enclosure surrounding the lower housing and at least a portion of the upper housing of a support member;

wherein the upper and lower housing move together to a compressed configuration when a force is exerted on the pallet thereby compressing the shock absorbing material and wherein the upper and lower housing move apart to an expanded configuration causing the shock absorbing material to expand when the force on the pallet is reduced or removed.

2. A pallet as in claim 1, wherein the shock absorbing material is an elastomeric material.

3. A pallet as in claim 2, wherein the shock absorbing material is Sorbothane.

4. A pallet as in claim 1, further comprising a center bolt attached to the lower housing and passing through an orifice in the shock absorbing material, an orifice in the upper housing, and an aperture located in the base and engaging the upper face of the base, thereby attaching the support member to the base.

5. A shock absorbing pallet comprising:

a base having an upper face for receiving a load and a lower face; and a plurality of support members attached to the base wherein each support member comprises:

an upper housing;

a lower housing movably attached to the upper housing;

shock absorbing material located within the upper and lower housing; and at least one retaining bolt, wherein (a) the upper and lower housing move together to a compressed configuration when a force is exerted on the pallet thereby compressing the shock absorbing material, (b) the upper and lower housing move apart to an expanded configuration causing the shock absorbing material to expand when the force on the pallet is reduced or removed, and (c) the retaining bolt movably attaches the lower housing to the upper housing such that the upper housing and lower housing can move between the compressed and expanded configurations.

6. A pallet as in claim 5, wherein the top end of the at least one retaining bolt is located within a vertical recess in the upper housing and the bottom end of the retaining bolt is located within a vertical recess in the lower housing, the vertical recess within the upper housing is reciprocal to the vertical recess within the lower housing, and wherein each recess comprises a wide portion and a narrow portion, the narrow portion preventing passage of the retaining bolt from the recess.

7. A pallet as in claim 6, further comprising a spring located in the wide portion of the recess in the upper housing, wherein one end of the spring is attached to the base of the vertical recess and the other end of the spring is attached to the top of the retaining bolt, the spring causing the upper housing and lower housing to move to the expanded configuration.

8. A shock absorbing pallet comprising:

a base having an upper face for receiving a load and a lower face; and a plurality of support members attached to the base wherein each support member comprises:

an upper housing;

a lower housing movably attached to the upper housing;

shock absorbing material located within the upper and lower housing; and four retaining bolts, wherein (a) the upper and lower housing move together to a compressed configuration when a force is exerted on the pallet thereby compressing the shock absorbing material, (b) the upper and lower housing move apart to an expanded configuration causing the shock absorbing material to expand when the force on the pallet is reduced or removed, and (c) the retaining bolts moveably attach the lower housing to the upper housing such that the upper housing and lower housing can move between the compressed and expanded configurations, and wherein the upper housing and lower housing are substantially rectangular having four corners and the four retaining bolts are located proximate respective corners of the upper housing and the lower housing.

9. A pallet as in claim 1, wherein the upper housing is lowered into the support member enclosure when the upper housing and lower housing move to the compressed configuration.

10. A pallet as in claim 9, further comprising a center bolt attached to the bottom of the support member enclosure and passing through an orifice in the shock absorbing material, an orifice in the upper housing, an orifice in the lower housing and an aperture located in the base and engaging the upper face of the base, thereby attaching the support member to the base.

11. A pallet as in claim 1, wherein the support member enclosure is made of polymer resin.

12. A pallet as in claim 11, wherein the support member enclosure is made of high density polyethylene.

13. A pallet as in claim 1, wherein the support members are attached to the lower face of the base.

14. A pallet as in claim 1, wherein the base is substantially rectangular having four corners and the plurality of support members are spaced about the base such that proximate each corner is positioned one of the plurality of support members.

15. A pallet as in claim 1 wherein the upper housing and lower housing are made of polymer resin.

16. A pallet as in claim 15, wherein the upper housing and lower housing are made of high density polyethylene.

17. A pallet as in claim 1, wherein the base is made of polymer resin.

18. A pallet as in claim 1, wherein the base is made of high density polyethylene.

* * * * *